US008657125B2

(12) United States Patent
Hsieh et al.

(10) Patent No.: US 8,657,125 B2
(45) Date of Patent: Feb. 25, 2014

(54) TRAY CLEANING APPARATUS FOR ELECTRONIC COMPONENTS

(75) Inventors: Wen-I Hsieh, Hsinchu County (TW); Te-Cheng Yang, Hsinchu (TW); Huan-Kuen Chen, Taichung (TW)

(73) Assignee: Chipbond Technology Corporation, Hsinchu (TW)

( * ) Notice: Subject to any disclaimer, the term of this patent is extended or adjusted under 35 U.S.C. 154(b) by 246 days.

(21) Appl. No.: 13/298,097

(22) Filed: Nov. 16, 2011

(65) Prior Publication Data

US 2012/0312765 A1 Dec. 13, 2012

(30) Foreign Application Priority Data

Jun. 8, 2011 (TW) ..... 100210324 U

(51) Int. Cl.
*A47G 29/00* (2006.01)

(52) U.S. Cl.
CPC ..... *A47G 29/00* (2013.01)
USPC ..... 211/41.17; 206/707

(58) Field of Classification Search
USPC ..... 211/41.12, 41.13, 41.14, 41.15, 41.16, 211/41.17; 312/9.48; 206/707, 711, 722, 206/307.1, 387.12, 387.15, 706; 34/192, 34/237
See application file for complete search history.

(56) References Cited

U.S. PATENT DOCUMENTS 3,938,871 A * 2/1976 Bartholomew ..... 312/240
4,600,231 A * 7/1986 Sickles ..... 294/161
4,664,265 A * 5/1987 George, Jr. ..... 211/41.17
4,678,245 A * 7/1987 Fouassier ..... 312/9.22
4,819,801 A * 4/1989 Howard ..... 206/307
5,042,671 A * 8/1991 Bischoff et al. ..... 211/41.18
5,183,177 A * 2/1993 Yu ..... 220/523
5,320,244 A * 6/1994 Yu ..... 220/507
5,377,080 A * 12/1994 Lin ..... 361/756
5,749,477 A * 5/1998 Chang ..... 211/40
5,853,214 A * 12/1998 Babbs et al. ..... 294/161
5,934,463 A * 8/1999 Yu ..... 206/307.1
6,092,981 A * 7/2000 Pfeiffer et al. ..... 414/810
6,155,426 A * 12/2000 Matsuda et al. ..... 206/708
6,186,344 B1 * 2/2001 Park et al. ..... 211/41.1
6,288,902 B1 * 9/2001 Kim et al. ..... 361/725
6,442,035 B1 * 8/2002 Perry et al. ..... 361/756
7,978,279 B2 * 7/2011 Chung ..... 349/58
2004/0069680 A1 * 4/2004 Song ..... 206/711
2006/0011507 A1 * 1/2006 Uchida et al. ..... 206/711
2006/0226093 A1 * 10/2006 Cho et al. ..... 211/41.14
2006/0283774 A1 * 12/2006 Hasegawa et al. ..... 206/725

* cited by examiner

*Primary Examiner* — Michael Safavi
(74) *Attorney, Agent, or Firm* — Jackson IPG PLLC

(57) ABSTRACT

A tray cleaning apparatus having a top plate, a bottom plate, a first bearing plate assembly and a second bearing plate assembly. The first bearing plate assembly disposed between top plate and bottom plate comprises a first supporting plate, plural first blocks and plural second blocks, the first supporting plate comprises an inner surface having a first disposing area and a second disposing area. The first blocks are disposed at the first disposing area and the second blocks are disposed at the second disposing area. The second bearing plate assembly disposed between top plate and bottom plate comprises a second supporting plate, plural third blocks and plural fourth blocks, the second supporting plate comprises an outer surface having a third disposing area and a fourth disposing area. The third blocks are disposed at the third disposing area and the fourth blocks are disposed at the fourth disposing area.

22 Claims, 12 Drawing Sheets

TRAY CLEANING APPARATUS FOR ELECTRONIC COMPONENTS

FIELD OF THE INVENTION

The present invention is generally relating to a tray cleaning apparatus, more particularly to the tray cleaning apparatus for electronic components.

BACKGROUND OF THE INVENTION

A conventional cleaning machine 10 at least includes a transportation apparatus 11 and a wash apparatus 12 as shown in FIG. 1. A plurality of electronic component trays P are fixed at the transportation apparatus 11, and mentioned transportation apparatus 11 is capable of delivering the electronic component trays P. Afterwards, the electronic component trays P can be cleaned by means of the wash apparatus 12. However, the clean method described above can not remove the tiny dirt distributed around the electronic component trays P so that the electronic components might be easily contaminated.

SUMMARY

The primary object of the present invention is to provide a tray cleaning apparatus for electronic components comprising a top plate, a bottom plate, at least one first bearing plate assembly and at least one second bearing plate assembly. The top plate comprises a top surface, a bottom surface, a first left side and a first right side. The bottom plate comprises an upper surface, a lower surface, a second left side and a second right side. The first bearing plate assembly disposed between the top plate and the bottom plate comprises a first supporting plate, a plurality of first blocks and a plurality of second blocks, wherein the first supporting plate comprises an inner surface having a first disposing area and a second disposing area. The first blocks are disposed at the first disposing area, the second blocks are disposed at the second disposing area, a first insertion slot is formed between adjacent first blocks, a second insertion slot is formed between adjacent second blocks, and each of the first insertion slots is corresponded to each of the second insertion slots. The second bearing plate assembly disposed between the top plate and the bottom plate comprises a second supporting plate, a plurality of third blocks and a plurality of fourth blocks, wherein the second supporting plate comprises at least one outer surface faced toward the inner surface. The outer surface comprises a third disposing area and a fourth disposing area, the third blocks are disposed at the third disposing area, and the fourth blocks are disposed at the fourth disposing area. A third insertion slot is formed between adjacent third blocks, a fourth insertion slot is formed between adjacent fourth blocks, each of the third insertion slots is corresponded to each of the fourth insertion slots, each of the third blocks is corresponded to each of the first blocks, and each of the fourth blocks is corresponded to each of the second blocks. For the reason that the first insertion slot and the second insertion slot are corresponded with each other, the third insertion slot and the fourth insertion slot are corresponded with each other, a plurality of component trays can be accommodated in the tray cleaning apparatus for electronic components. Besides, the dirt attached on the component trays can be cleaned and removed through centrifugal force of spinning in a wash machine.

DETAILED DESCRIPTION OF THE INVENTION

Figure 1:
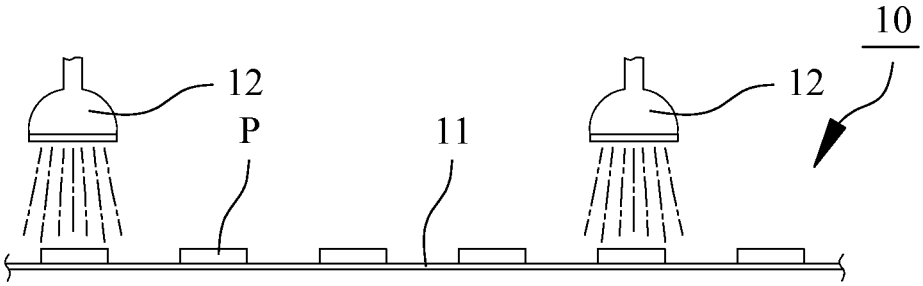
FIG. 1 PRIOR ART
FIG. 1 is a lateral view of a conventional cleaning machine
Figure 2:
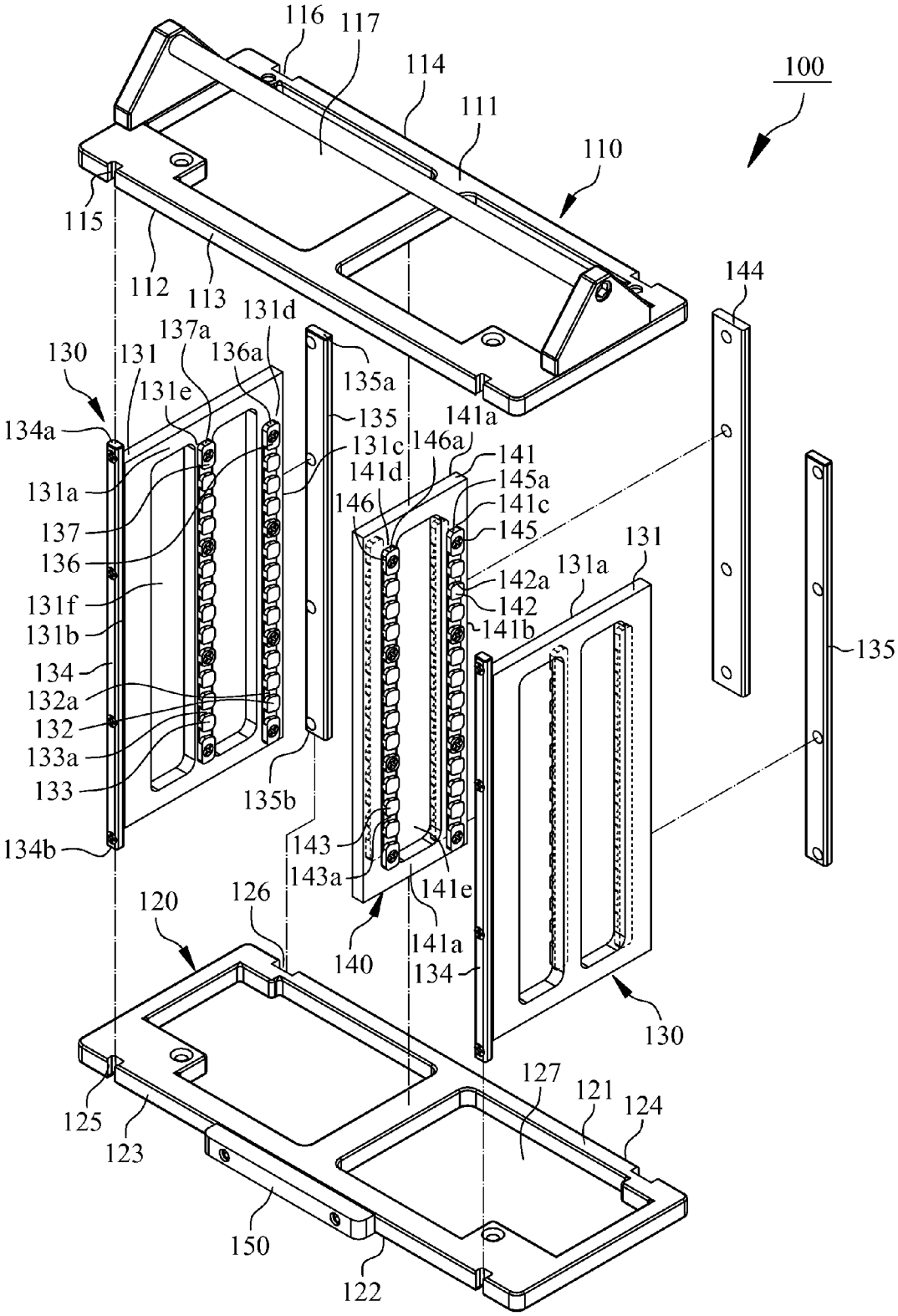
FIG. 2 is an exploded view illustrating a tray cleaning apparatus for electronic components in accordance with a first preferred embodiment of the present invention.
Figure 3:
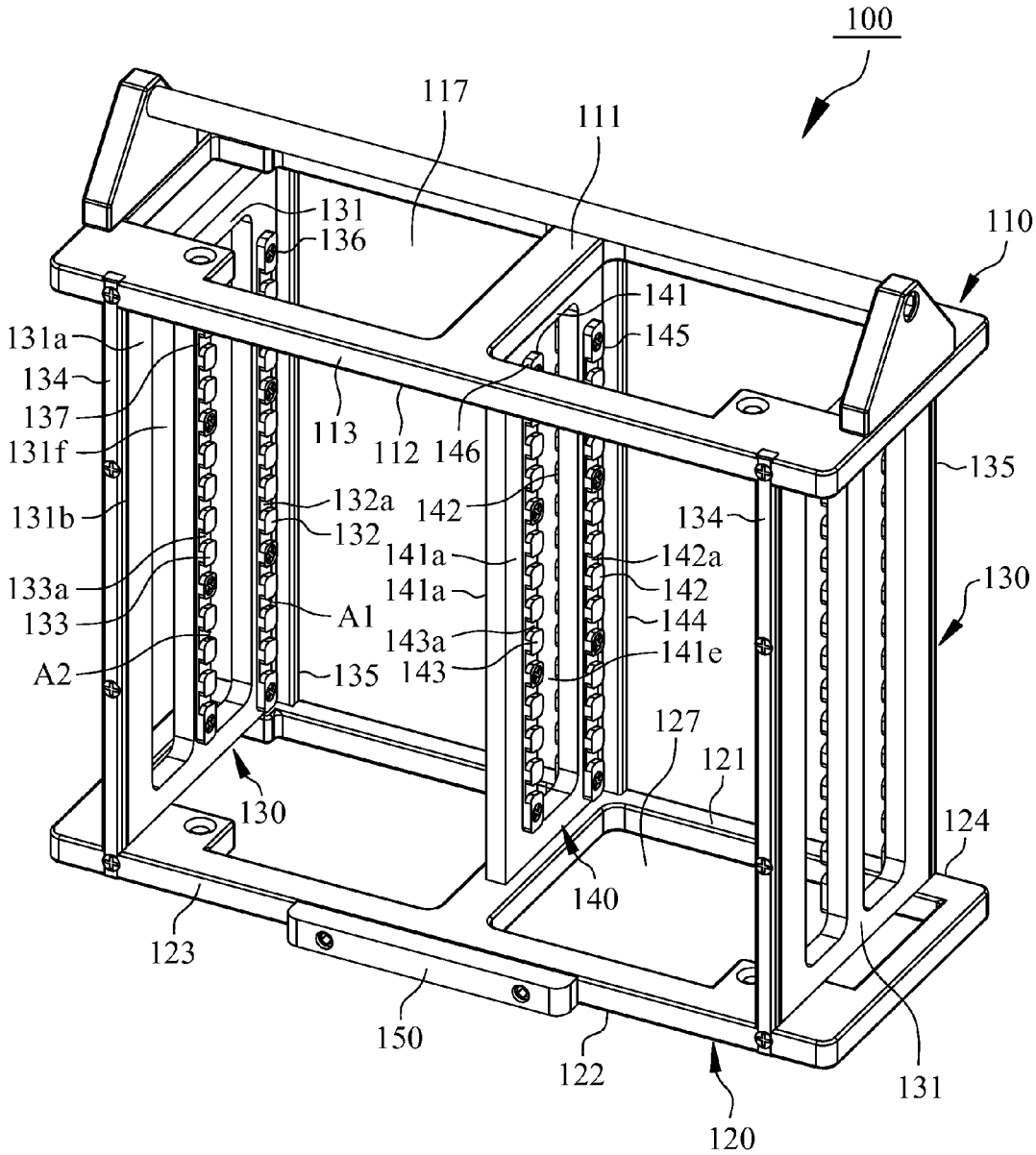
FIG. 3 is an assembly view illustrating the tray cleaning apparatus for electronic components in accordance with a first preferred embodiment of the present invention.
Figure 4:
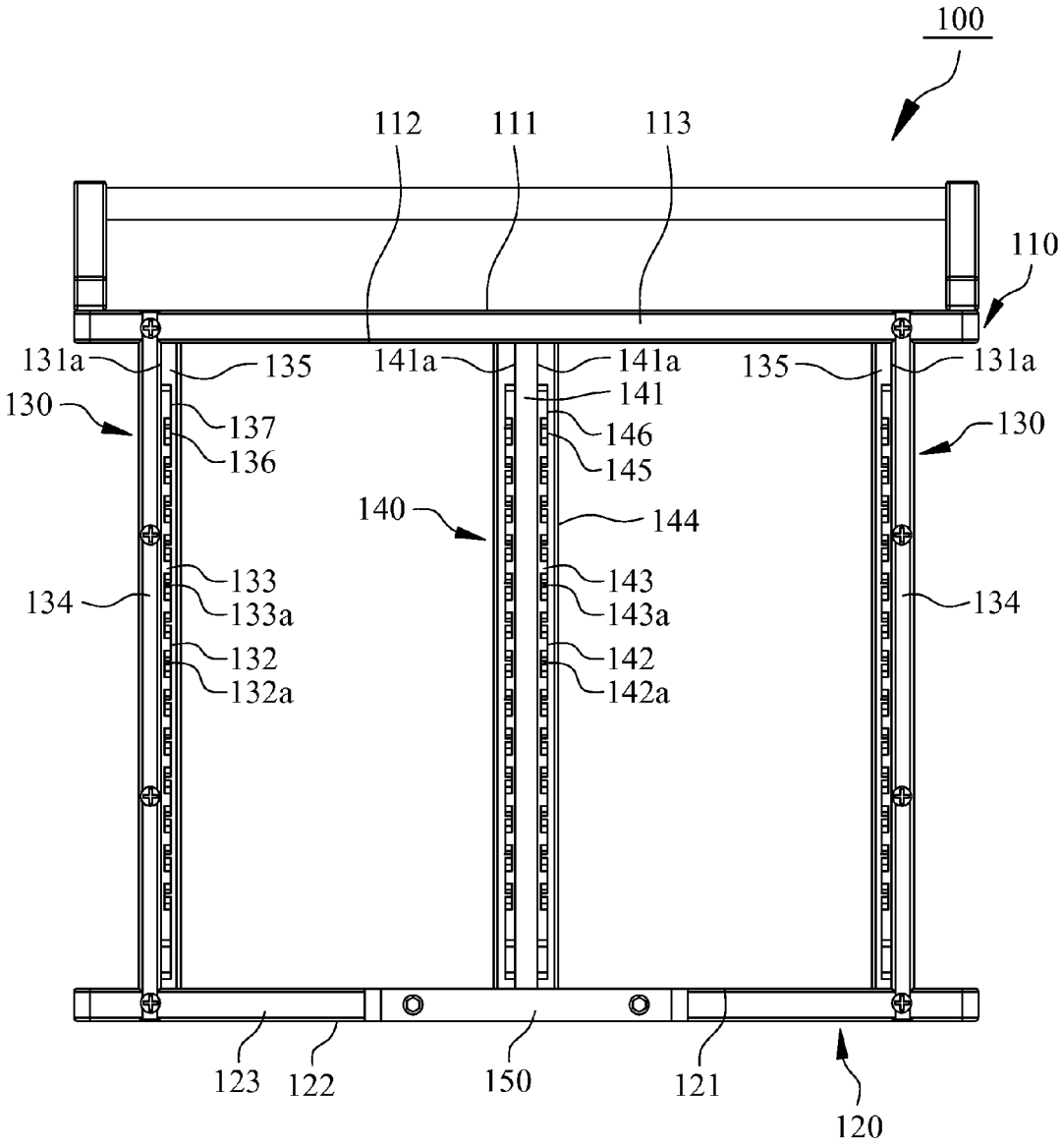
FIG. 4 is a front view illustrating the tray cleaning apparatus for electronic components in accordance with a first preferred embodiment of the present invention.

Please referring to FIGS. 2 and 3, a tray cleaning apparatus for electronic components 100 in accordance with a first preferred embodiment of the present invention comprises a top plate 110, a bottom plate 120, at least one first bearing plate assembly 130 and at least one second bearing plate assembly 140. The top plate 110 comprises a top surface 111, a bottom surface 112, a first left side 113, a first right side 114, a first coupling slot 115 recessed from the first left side 113 and a first connection slot 116 recessed from the first right side 114, wherein the first coupling slot 115 is in communication with the bottom surface 112 and the top surface 111. The bottom plate 120 comprises an upper surface 121, a lower surface 122, a second left side 123, a second right side 124, a second coupling slot 125 recessed from the second left side 123 and a second connection slot 126 recessed from the second right side 124, wherein the second coupling slot 125 is in communication with the upper surface 121 and the lower surface 122, and the second coupling slot 125 is corresponded with the first coupling slot 115. The first bearing plate assembly 130 disposed between the top plate 110 and the bottom plate 120 comprises a first supporting plate 131, a plurality of first blocks 132, a plurality of second blocks 133, a first coupling plate 134 and a first blocking plate 135. The first supporting plate 131 comprises an inner surface 131*a*, a first left wall 131*b* and a first right wall 131*c*, wherein the inner surface 131*a* comprises a first disposing area 131*d* and a second disposing area 131*e*, the first blocks 132 are disposed at the first disposing area 131*d*, and the second blocks 133 are disposed at the second disposing area 131*e*. A first insertion slot 132*a* is formed between adjacent first blocks 132, a second insertion slot 133*a* is formed between adjacent second blocks 133, and each of the first insertion slots 132*a* is corresponded to each of the second insertion slots 133*a*. Please refers to FIGS. 3 and 4, the first coupling plate 134 is disposed at the first left wall 131*b* of the first supporting plate 131, one end of the first coupling plate 134 comprises a first bulge portion 134*a*, another end of the first coupling plate 134 comprises a second bulge portion 134*b*, the first bulge portion 134*a* is coupled with the first coupling slot 115, and the second bulge portion 134*b* is coupled with the second coupling slot 125. The first blocking plate 135 is located and disposed at the first right wall 131*c* of the first supporting plate 131. In this embodiment, the blocking plate 135 comprises a first top end portion 135*a* coupled with the first connection slot 116 and a first bottom end portion 135*b* coupled with the second connection slot 126.

With reference to FIGS. 2 and 3 again, the second bearing plate assembly 140 disposed between the top plate 110 and the bottom plate 120 comprises a second supporting plate 141, a plurality of third blocks 142, a plurality of fourth blocks 143 and a second blocking plate 144, wherein the second supporting plate 141 comprises at least one outer surface 141*a* and a second right wall 141*b*. The outer surface 141*a* is faced toward the inner surface 131*a*, mentioned outer surface 141*a* comprises a third disposing area 141*c* and a fourth disposing area 141*d*, the third blocks 142 are disposed at the third disposing area 141*c*, and the fourth blocks 143 are disposed at the fourth disposing area 141*d*. A third insertion slot 142*a* is formed between adjacent third blocks 142, a fourth insertion slot 143*a* is formed between adjacent fourth blocks 143, each of the third insertion slots 142*a* is corresponded to each of the fourth insertion slots 143*a*, each of the third blocks 142 is corresponded to each of the first blocks 132, and each of the fourth blocks 143 is corresponded to each of the second blocks 133. The second blocking plate 144 is located and disposed at the second right wall 141*b* of the second supporting plate 141.

Figure 5:
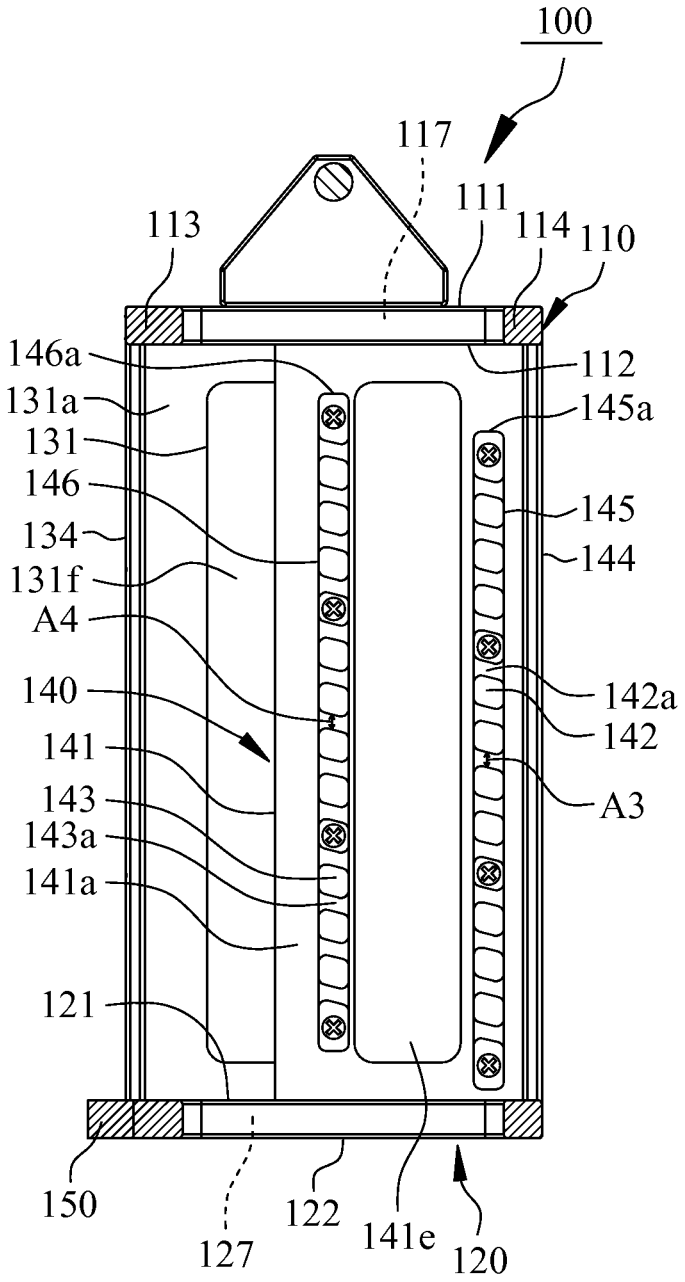
FIG. 5 is a lateral view illustrating the tray cleaning apparatus for electronic components in accordance with a first preferred embodiment of the present invention.
Figure 6:
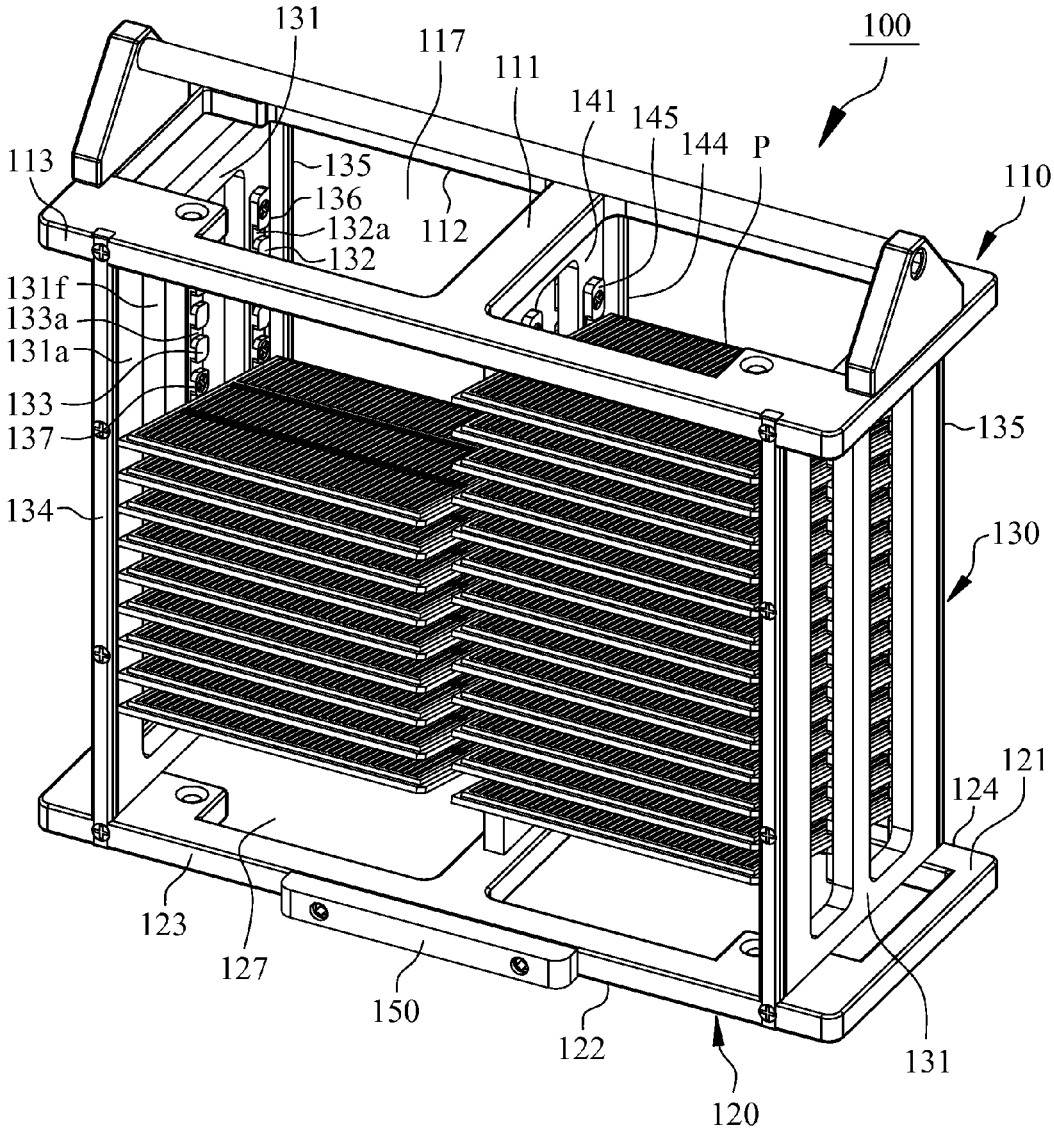
FIG. 6 is a three-dimensional view illustrating a plurality of component trays disposed at the tray cleaning apparatus in accordance with a first preferred embodiment of the present invention.

Besides, referring to FIGS. 2 and 5, in this embodiment, the first bearing plate assembly 130 comprises a first rib 136 disposed at the first disposing area 131*d* and a second rib 137 disposed at the second disposing area 131*e*, the first blocks 132 are located at the first rib 136, and the second blocks 133 are located at the second rib 137. The first rib 136 comprises a first rib surface 136*a*, and the second rib 137 comprises a second rib surface 137*a* that is not aligned with the first rib surface 136*a*. The second bearing plate assembly 140 comprises a third rib 145 disposed at the third disposing area 141*c* and a fourth rib 146 disposed at the fourth disposing area 141*d*, the third blocks 142 are located at the third rib 145, and the fourth blocks 143 are located at the fourth rib 146. The third rib 145 comprises a third rib surface 145*a*, and the fourth rib 146 comprises a fourth rib surface 146*a* that is not aligned with the third rib surface 145*a*. Referring to FIG. 6, when a plurality of component trays P are disposed at the tray cleaning apparatus for electronic components 100, each of the component trays P comprises an inclined angle formed by unaligned relationship between the first rib surface 136*a* and the second rib surface 137*a* and another unaligned relationship between the third rib surface 145*a* and the fourth rib surface 146*a*. Preferably, with reference to FIGS. 3 and 6, the top plate 110 at least comprises an upper slot opening 117 penetrated through the top surface 111 and the bottom surface 112, the bottom plate 120 at least comprises a lower slot opening 127 penetrated through the upper surface 121 and the lower surface 122, and the lower slot opening 127 is corresponded to the upper slot opening 117. The first supporting plate 131 at least comprises a first opening 131*f*, and the second supporting plate 141 at least comprises a second opening 141*e*. In the process of washing, the used water can be drained away from the upper slot opening 117, the lower slot opening 127, the first opening 131*f* and the second opening 141*e*.

Furthermore, referring to FIGS. 2 and 3 again, the tray cleaning apparatus for electronic components 100 further includes a fool-proof device 150 disposed at the first left side 113 of the top plate 110 or the second left side 123 of the bottom plate 120. In this embodiment, the fool-proof device 150 is disposed at the second left side 123 of the bottom plate 120. With reference to FIGS. 3 and 5 again, a first included angle A1 is formed between adjacent first blocks 132, a second included angle A2 is formed between adjacent second blocks 133, the first included angle A1 is not larger than 180 degrees, and the second included angle A2 is not larger than 180 degrees as well. A third included angle A3 is formed between adjacent third blocks 142, a fourth included angle A4 is formed between adjacent fourth blocks 143, the third included angle A3 is not larger than 180 degrees, and the fourth included angle A4 is not larger than 180 degrees as well. In this embodiment, the first included angle A1, the second included angle A2, the third included angle A3 and the fourth included angle A4 range between 90 to 180 degrees. For the reason that the first insertion slot 132*a* and the second insertion slot 133*a* are corresponded with each other, the third insertion slot 142*a* and the fourth insertion slot 143*a* are corresponded with each other, a plurality of component trays P can be accommodated in the tray cleaning apparatus for electronic components 100. Besides, the dirt attached on the component trays P can be cleaned and removed through centrifugal force of spinning in a wash machine (not shown in Figs.) therefore raising yield rate. Additionally, the first blocking plate 135 and the second blocking plate 144 may prevent the component trays P to depart from the tray cleaning apparatus 100.

Figure 7:
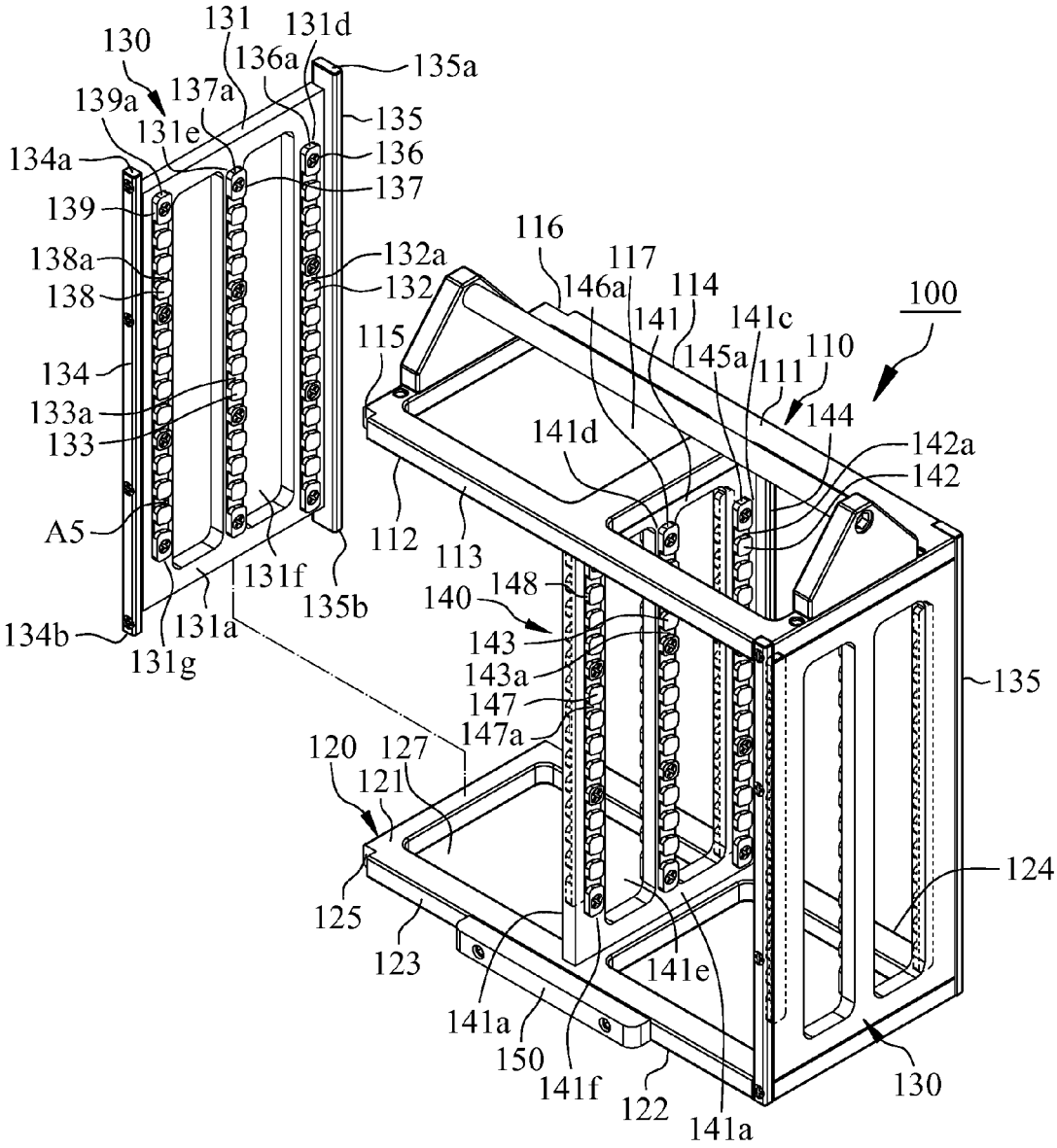
FIG. 7 is another exploded view illustrating the tray cleaning apparatus for electronic components in accordance with a second preferred embodiment of the present invention.
Figure 8:
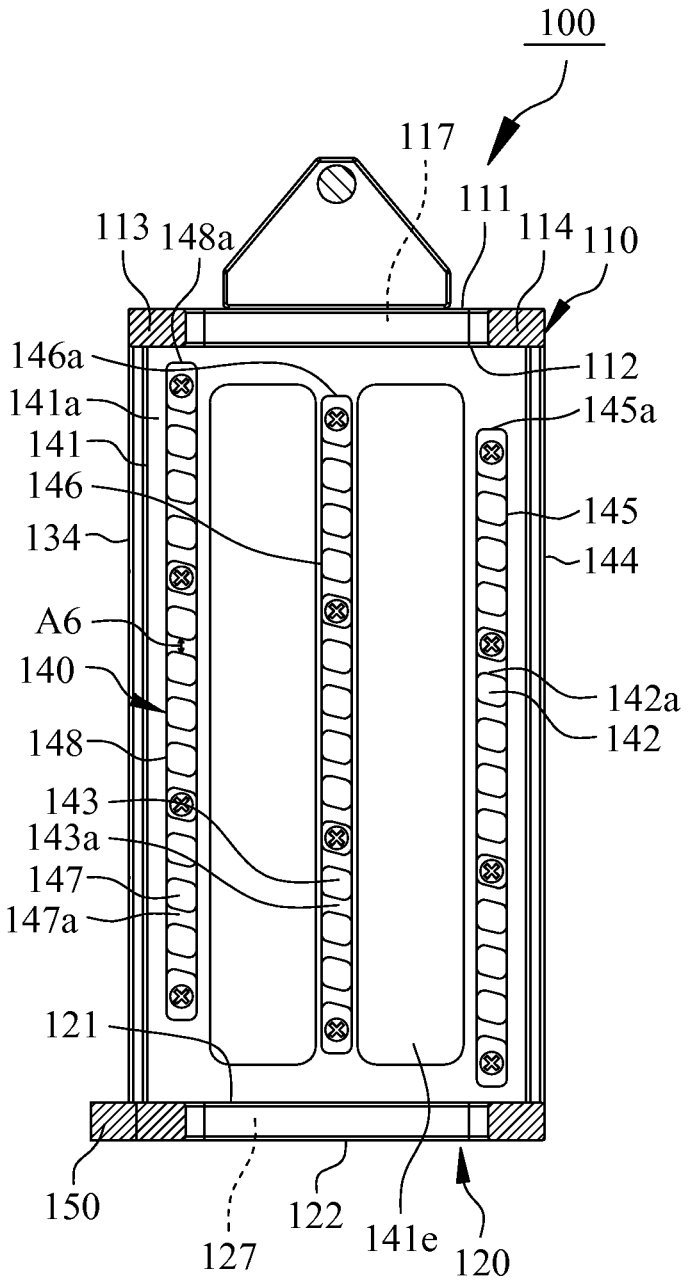
FIG. 8 is a lateral view illustrating the tray cleaning apparatus for electronic components in accordance with a second preferred embodiment of the present invention.
Figure 9:
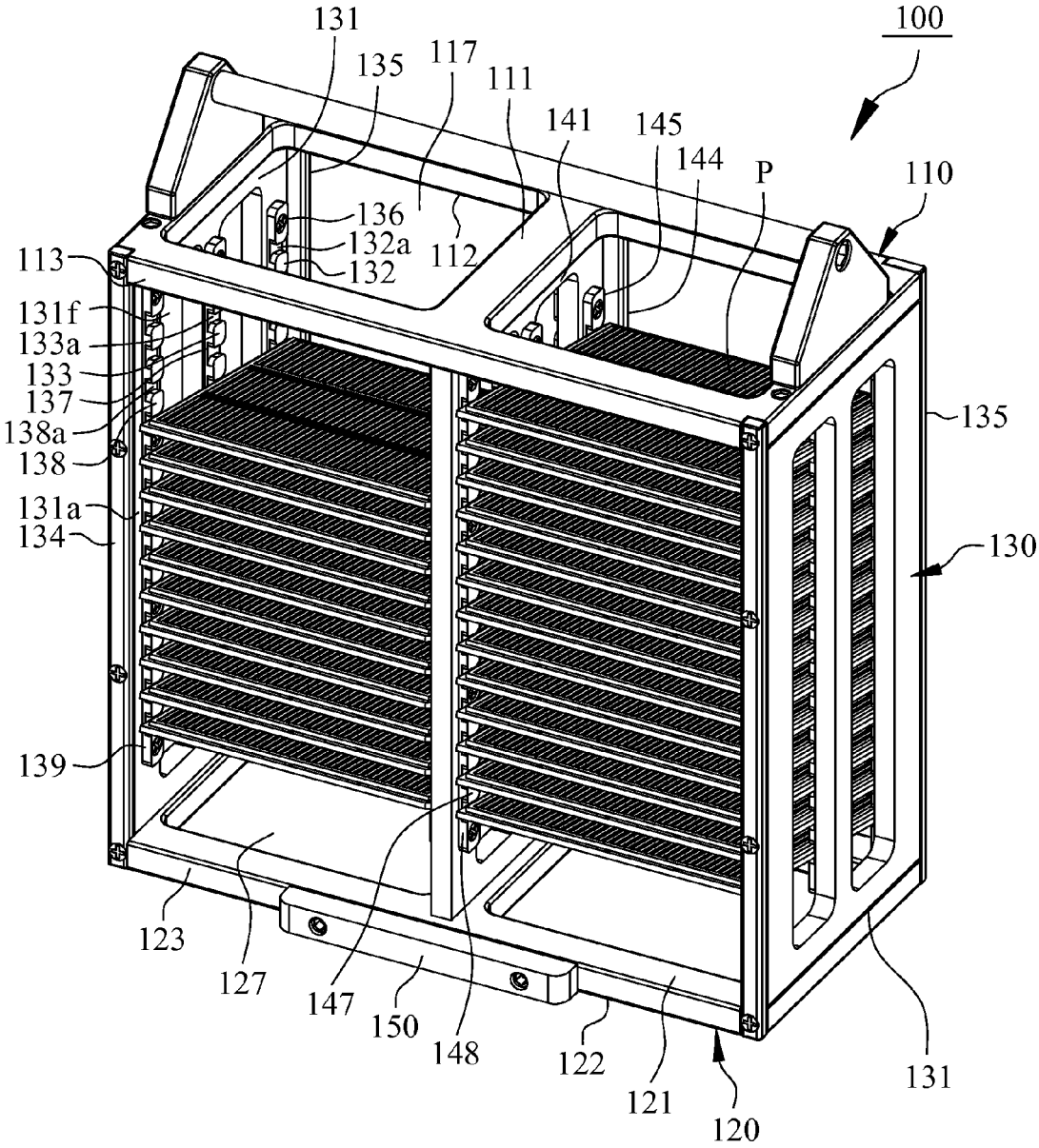
FIG. 9 is a three-dimensional view illustrating a plurality of component trays disposed at the tray cleaning apparatus in accordance with a second preferred embodiment of the present invention.

Referring to FIGS. 7 and 8, in another embodiment, the first bearing plate assembly 130 further comprises a plurality of fifth blocks 138 and a fifth rib 139, the inner surface 131*a* of the first supporting plate 131 further comprises a fifth disposing area 131*g*, the fifth blocks 138 are disposed at the fifth disposing area 131*g*, a fifth insertion slot 138*a* is formed between adjacent fifth blocks 138, and each of the fifth insertion slots 138*a* is corresponded to each of the second insertion slots 133*a*. The fifth blocks 138 are located at the fifth rib 139 disposed at the fifth disposing area 131*g*. The fifth rib 139 comprises a fifth rib surface 139*a* that is not aligned with the second rib surface 137*a* and the first rib surface 136*a*. Besides, the second bearing plate assembly 140 further comprises a plurality of sixth blocks 147 and a sixth rib 148, the outer surface 141*a* of the second supporting plate 141 further comprises a sixth disposing area 141*f*, the sixth blocks 147 are disposed at the sixth disposing area 141*f*, a sixth insertion slot 147*a* is formed between adjacent sixth blocks 147, and each of the sixth insertion slots 147*a* is corresponded to each of the fourth insertion slots 143*a*. The sixth blocks 147 are located at the sixth rib 148 disposed at the sixth disposing area 141*f*. The sixth rib 148 comprises a sixth rib surface 148*a* that is not aligned with the third rib surface 145*a* and the fourth rib surface 146*a*. A fifth included angle A5 is formed between adjacent fifth blocks 138, a sixth included angle A6 is formed between adjacent sixth blocks 147, the fifth included angle A5 is not larger than 180 degrees, and the sixth included angle A6 is not larger than 180 degrees as well. In this embodiment, the fifth included angle A5 and the sixth included angle A6 range between 90 to 180 degrees. Referring to FIG. 9, with the attachment of the fifth blocks 138 and the sixth blocks 147, the stability for the component trays P disposed at the tray cleaning apparatus 100 can be effectively raised.

Figure 10:
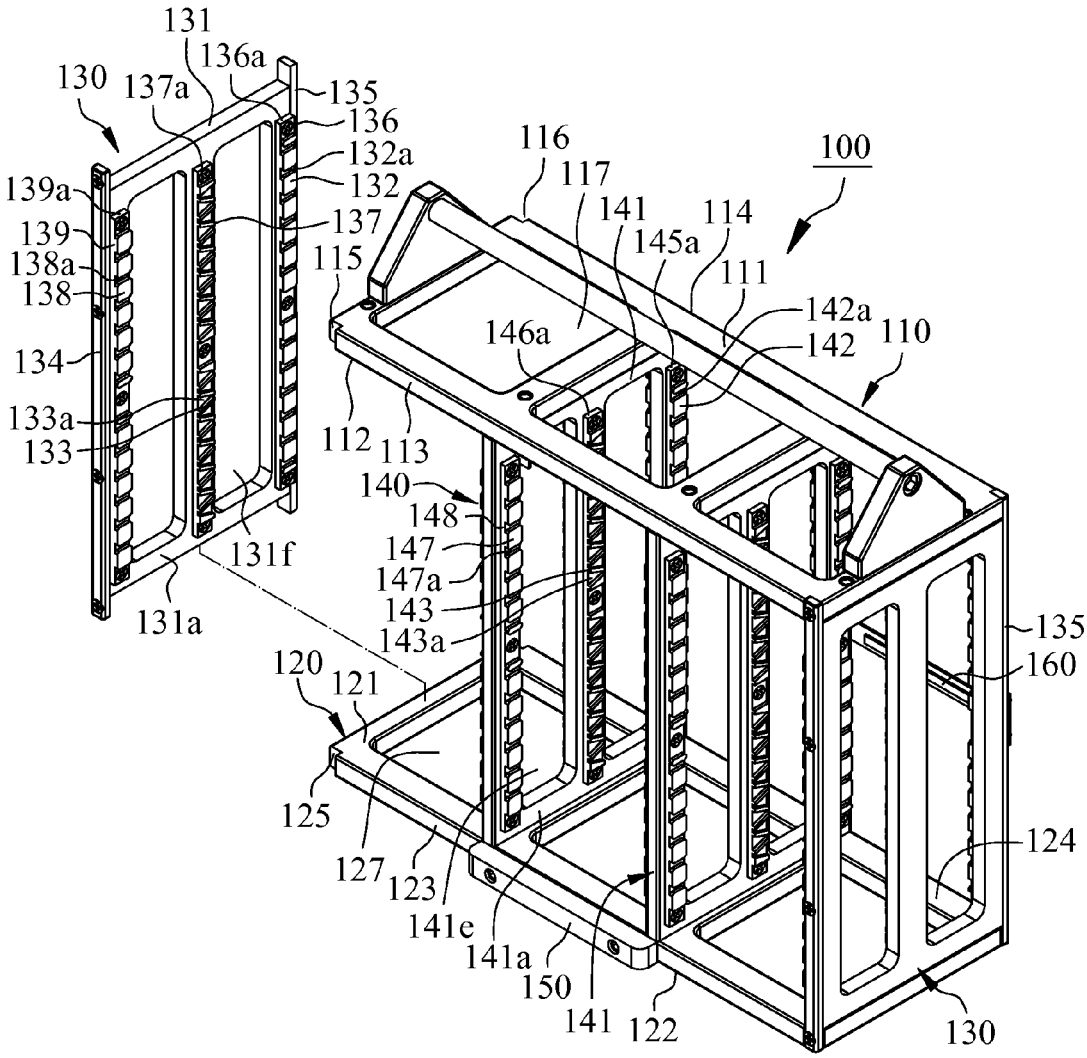
FIG. 10 is another exploded view illustrating a tray cleaning apparatus for electronic components in accordance with a third preferred embodiment of the present invention.
Figure 11:
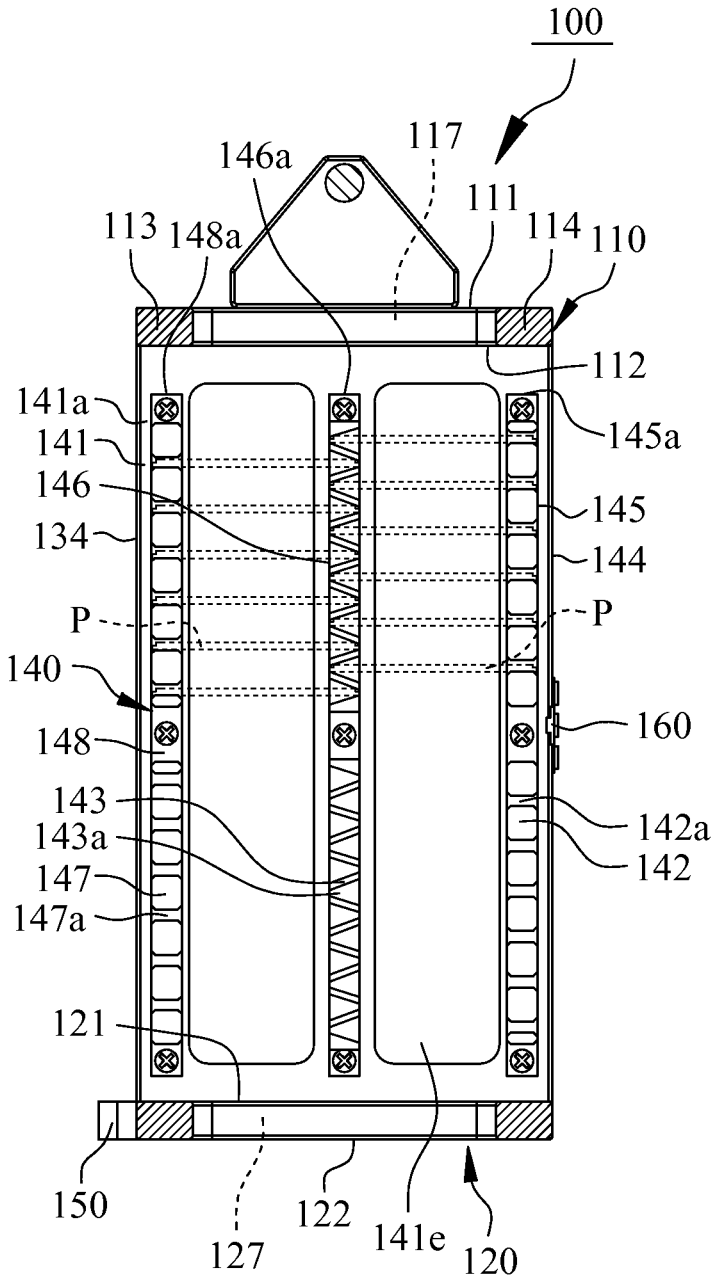
FIG. 11 is a lateral view illustrating the tray cleaning apparatus for electronic components in accordance with a third preferred embodiment of the present invention.
Figure 12:
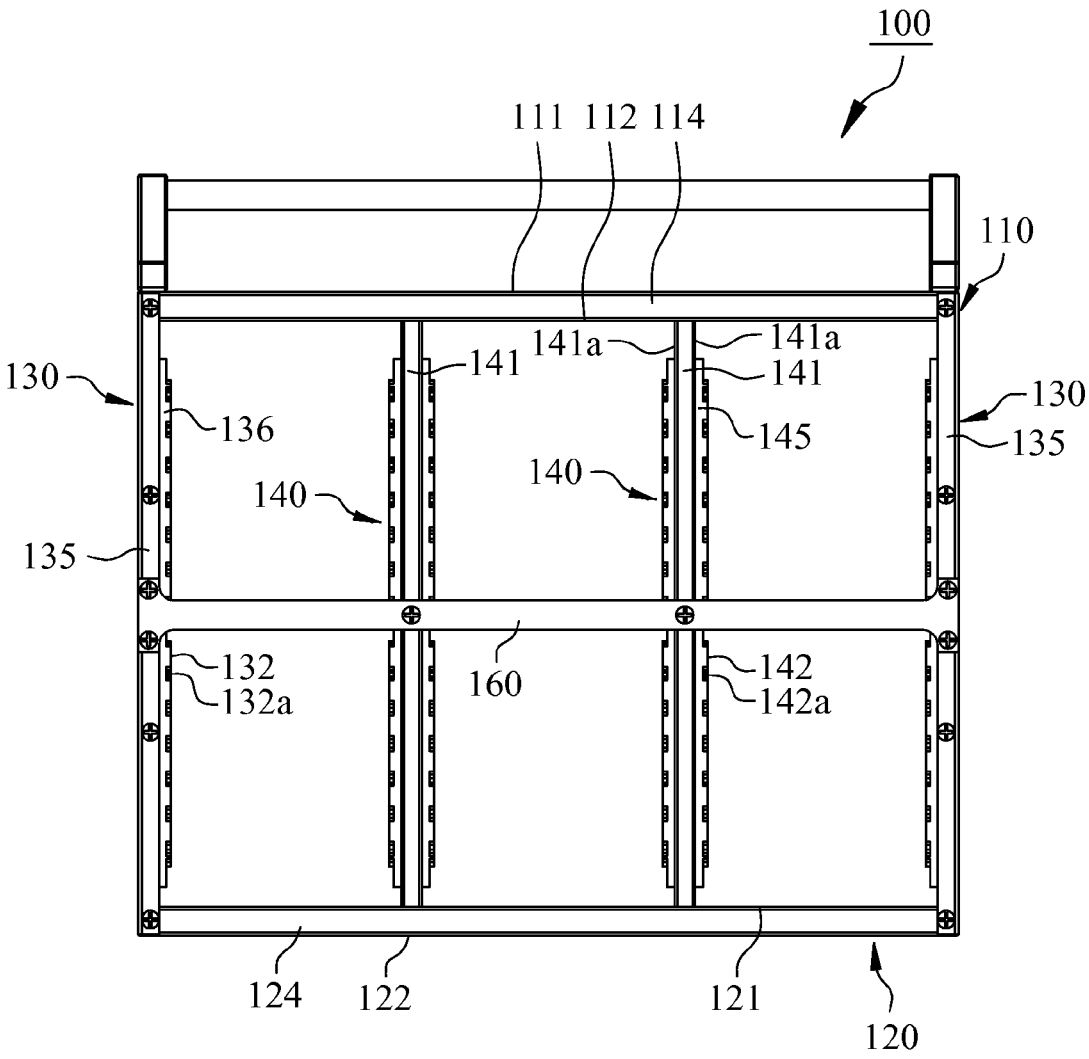
FIG. 12 is a rear view illustrating the tray cleaning apparatus for electronic components in accordance with a third preferred embodiment of the present invention.

Or, with reference to FIGS. 10, 11 and 12, the first rib surface 136*a*, the second rib surface 137*a* and the fifth rib surface 139*a* are aligned with each other, and the third rib surface 145*a*, the fourth rib surface 146*a* and the sixth rib surface 148*a* are aligned with each other. The first included angle A1, the third included angle A3, the fifth included angle A5 and the sixth included angle A6 range from 90 to 180 degrees. The second included angle A2 is smaller than 90 degrees, and the fourth included angle A4 is smaller than 90 degrees. Accordingly, the tray cleaning apparatus for electronic components 100 further includes a reinforcement plate 160 means for strengthening the link between the first bearing plate assembly 130 and the second bearing plate assembly 140.

While this invention has been particularly illustrated and described in detail with respect to the preferred embodiments thereof, it will be clearly understood by those skilled in the art that it is not limited to the specific features and describes and various modifications and changes in form and details may be made without departing from the spirit and scope of this invention.

What is claimed is:

1. A tray cleaning apparatus for electronic components comprises:

a top plate having a top surface, a bottom surface, a first left side and a first right side;

a bottom plate having an upper surface, a lower surface, a second left side and a second right side;

at least one first bearing plate assembly disposed between the top plate and the bottom plate, the first bearing plate assembly comprises a first supporting plate, a plurality of first blocks and a plurality of second blocks, wherein the first supporting plate comprises an inner surface having a first disposing area and a second disposing area, the first blocks are disposed at the first disposing area, the second blocks are disposed at the second disposing area, a first insertion slot is formed between adjacent first blocks, a second insertion slot is formed between adjacent second blocks, and the first insertion slot is corresponded to the second insertion slot; and wherein the first bearing plate assembly further comprises a first blocking plate, the first supporting plate further comprises a first right wall, the first blocking plate is located at the first right wall of the first supporting plate;

wherein the top plate comprises a first connection slot recessed from the first right side, the bottom plate comprises a second connection slot recessed from the second right side, the first blocking plate comprises a first top end portion and a first bottom end portion, wherein the first top end portion is coupled with the first connection slot, and the first bottom end portion is coupled with the second connection slot;

at least one second bearing plate assembly disposed between the top plate and the bottom plate, the second bearing plate assembly comprises a second supporting plate, a plurality of third blocks and a plurality of fourth blocks, wherein the second supporting plate comprises at least one outer surface faced toward the inner surface, the outer surface comprises a third disposing area and a fourth disposing area, the third blocks are disposed at the third disposing area, the fourth blocks are disposed at the fourth disposing area, a third insertion slot is formed between adjacent third blocks, a fourth insertion slot is formed between adjacent fourth blocks, the third insertion slot is corresponded to the fourth insertion slot, each of the third blocks is corresponded to each of the first blocks, and each of the fourth blocks is corresponded to each of the second blocks.

2. The tray cleaning apparatus for electronic components in accordance with claim 1, wherein the first bearing plate assembly further comprises a first coupling plate, the first supporting plate further comprises a first left wall, the first coupling plate is disposed at the first left wall of the first supporting plate, one end of the first supporting plate comprises a first coupling portion, and another end of the first supporting plate comprises a second coupling portion.

3. The tray cleaning apparatus for electronic components in accordance with claim 2, wherein the top plate comprises a first coupling slot recessed from the first left side, the bottom plate comprises a second coupling slot recessed from the second left side, wherein the second coupling slot is corresponded to the first coupling slot, the first coupling portion is coupled with the first coupling slot, and the second coupling portion is coupled with the second coupling slot.

4. The tray cleaning apparatus for electronic components in accordance with claim 1, wherein the first blocking plate is disposed at the first right wall of the first supporting plate.

5. The tray cleaning apparatus for electronic components in accordance with claim 1, wherein the second bearing plate assembly further comprises a second blocking plate, the second supporting plate further comprises a second right wall, the second blocking plate is located at the second right wall of the second supporting plate.

6. The tray cleaning apparatus for electronic components in accordance with claim 5, wherein the second blocking plate is disposed at the second right wall of the second supporting plate.

7. The tray cleaning apparatus for electronic components in accordance with claim 1, wherein the top plate at least comprises an upper slot opening penetrated through the top surface and the bottom surface.

8. The tray cleaning apparatus for electronic components in accordance with claim 7, wherein the bottom plate at least comprises a lower slot opening penetrated through the upper surface and the lower surface, the lower slot opening is corresponded to the upper slot opening.

9. The tray cleaning apparatus for electronic components in accordance with claim 1 further includes a protrusion disposed at the first left side of the top plate.

10. The tray cleaning apparatus for electronic components in accordance with claim 1 further includes a protrusion disposed at the second left side of the bottom plate.

11. The tray cleaning apparatus for electronic components in accordance with claim 1, wherein the first bearing plate assembly comprises a first rib disposed at the first disposing area and a second rib disposed at the second disposing area, the first blocks are located at the first rib, and the second blocks are located at the second rib.

12. The tray cleaning apparatus for electronic components in accordance with claim 11, wherein the first rib comprises a first rib surface, the second rib comprises a second rib surface that is not aligned with the first rib surface.

13. The tray cleaning apparatus for electronic components in accordance with claim 1, wherein the second bearing plate assembly comprises a third rib disposed at the third disposing area and a fourth rib disposed at the fourth disposing area, the third blocks are located at the third rib, and the fourth blocks are located at the fourth rib.

14. The tray cleaning apparatus for electronic components in accordance with claim 13, wherein the third rib comprises a third rib surface, the fourth rib comprises a fourth rib surface that is not aligned with the third rib surface.

15. The tray cleaning apparatus for electronic components in accordance with claim 1, wherein a first included angle is formed between adjacent first blocks, a second included angle is formed between adjacent second blocks, the first included angle is not larger than 180 degrees, and the second included angle is not larger than 180 degrees.

16. The tray cleaning apparatus for electronic components in accordance with claim 1, wherein a third included angle is formed between adjacent third blocks, a fourth included angle is formed between adjacent fourth blocks, the third included angle is not larger than 180 degrees, and the fourth included angle is not larger than 180 degrees.

17. The tray cleaning apparatus for electronic components in accordance with claim 1, wherein the first bearing plate assembly further comprises a plurality of fifth blocks, the inner surface of the first supporting plate further comprises a fifth disposing area, the fifth blocks are disposed at the fifth disposing area, a fifth insertion slot is formed between adjacent fifth blocks, and each of the fifth insertion slots is corresponded to each of the second insertion slots.

18. The tray cleaning apparatus for electronic components in accordance with claim 1, wherein the second bearing plate assembly further comprises a plurality of sixth blocks, the outer surface of the second supporting plate further comprises a sixth disposing area, the sixth blocks are disposed at the sixth disposing area, a sixth insertion slot is formed between adjacent sixth blocks, and each of the sixth insertion slots is corresponded to each of the fourth insertion slots.

19. The tray cleaning apparatus for electronic components in accordance with claim 17, wherein the first bearing plate assembly comprises a fifth rib disposed at the fifth disposing area, and the fifth blocks are located at the fifth rib.

20. The tray cleaning apparatus for electronic components in accordance with claim 12, wherein the first bearing plate assembly comprises a fifth rib having a fifth rib surface, the first rib surface and the second rib surface are not aligned with the fifth rib surface.

21. The tray cleaning apparatus for electronic components in accordance with claim 18, wherein the second bearing plate assembly comprises a sixth rib disposed at the sixth disposing area, and the sixth blocks are located at the sixth rib.

22. The tray cleaning apparatus for electronic components in accordance with claim 14, wherein the second bearing plate assembly comprises a sixth rib having a sixth rib surface, the third rib surface and the fourth rib surface are not aligned with the sixth rib surface.

* * * * *